US006148966A

United States Patent [19]

Daugherty, Jr. et al.

[11] Patent Number: 6,148,966

[45] Date of Patent: Nov. 21, 2000

[54] ADAPTER SYSTEM FOR A RAILWAY VEHICLE BRAKING SYSTEM

[75] Inventors: David W. Daugherty, Jr., Plainfield; Michael J. Moriarity, Lansing, both of Ill.; Eric S. Graves, Crown Point, Ind.

[73] Assignee: Westinghouse Air Brake Company, Wilmerding, Pa.

[21] Appl. No.: 09/273,398

[22] Filed: Mar. 22, 1999

[51] Int. Cl.[7] ..... B61H 13/00

[52] U.S. Cl. ..... 188/52; 188/33; 188/198; 188/207; 188/219.1

[58] Field of Search ..... 188/52, 33, 197–202, 188/219.1, 205 R, 153 R, 207, 209, 213

[56] References Cited

U.S. PATENT DOCUMENTS

| | | | |
|---|---|---|---|
| 4,613,016 | 9/1986 | Hart et al. | 188/52 |
| 5,069,312 | 12/1991 | Kanjo et al. | 188/52 |

*Primary Examiner*—Douglas C. Butler

*Attorney, Agent, or Firm*—James Ray & Associates

[57] ABSTRACT

An adapter system for use in railway vehicle braking systems for increasing the height of a slack adjuster with respect to a force transfer lever in the braking system is provided. Increasing the height of the slack adjuster in the system results in better clearance of the slack adjuster through an opening of the truck bolster through which the slack adjuster extends in single-cylinder, truck-mounted braking systems. The adapter system of the invention comprises a J-shaped member which is engageable with the transfer lever of the braking system. This J-shaped member has a first portion extending above and substantially parallel with at least a portion of the transfer lever, a second portion positioned below an end of the transfer lever, and a third portion positioned adjacent an edge of the end of the transfer lever. The transfer lever is connected between the first and second portions of the J-shaped member. The jaw member portion of the slack adjuster is secured with the first portion of the J-shaped member such that a longitudinally disposed centerline of the slack adjuster is positioned a predetermined distance above a predetermined horizontally disposed plane of the transfer lever.

23 Claims, 3 Drawing Sheets

ADAPTER SYSTEM FOR A RAILWAY VEHICLE BRAKING SYSTEM

FIELD OF THE INVENTION

The present invention relates to railway vehicle braking systems and more particularly to an adapter system for use in railway vehicle braking systems for increasing the height of a force transmitting member in the railway vehicle braking system, and still more particularly an adapter system for use in railway vehicle braking systems for increasing the height of a slack adjuster to increase its clearance through the openings of the truck bolster in single-cylinder, truck-mounted braking systems.

BACKGROUND OF THE INVENTION

There is presently known in the prior art a single-cylinder, truck mounted brake rigging, as shown for example in U.S. Pat. Nos. 4,613,016 and 5,069,312 which have been designed for use with truss-type brake beams. In this respect, the braking force applied through the rigging acts on the respective brake beams at the beam midpoint where maximum resistance to bending forces is effective by reason of the beam strut arm transferring the load between the beam compression and tension members. Such a single-cylinder rigging, when combined with truss-types brake beams, is believed to offer maximum efficiency of operation at a relatively low cost.

A typical single-cylinder, truck mounted brake rigging generally comprises a pair of spaced apart brake beams having brake heads at each end thereof, a pair of transfer levers pivotally connected at a point intermediate the ends thereof to a respective one of the pair of spaced apart brake beams, and a pair of force-transmitting means, one of which includes a brake actuator means and the other of which typically includes a slack adjuster mechanism, connecting the pair of transfer levers so as to form a brake beam interacting linkage which causes the application of the brake heads to the wheels of the railway vehicle. This braking system is a freely suspended system that fits most standard trucks with combination bolsters, and requires no special bolsters or connections of any kind to existing bolsters or car body. As shown in FIG. 2, the single-cylinder, truck mounted braking system is designed such that the force transmitting members extend through openings in the bolster portion of the truck.

Some of the newer truck designs interfere with the slack adjuster force transmitting member at the location where the slack adjuster extends through the openings in the bolster portion of the truck. This interference causes undesirable rubbing of the slack adjuster against the bolster bowl area of the truck.

SUMMARY OF THE INVENTION

An object of the present invention is to provide an adapter system for increasing the height of a force transmitting means in a railway vehicle braking system.

A further object of the present invention is to provide a railway vehicle braking system including an adapter system for increasing the height of a slack adjuster type of force transmitting means to increase its clearance through the openings of the truck bolster in single-cylinder, truck-mounted braking systems.

A still further object of the present invention is to provide an adapter system for increasing the height of a slack adjuster type of force transmitting means which is particularly applicable to TMX[a] truck mounted type braking systems. (TMX[a] is a registered trademark to Westinghouse Airbrake Company, the assignee of the present invention).

Another object of the present invention is to provide an adapter system which may be quickly and easily applied onto the braking system thus providing a significant reduction in time and labor.

Still another object of the present invention is to provide an adapter system which enables a single-cylinder truck mounted braking system to be readily applied to a variety of truck designs having different opening locations and opening sizes through which the force transmitting means extend.

Briefly, and in accordance with the foregoing objects, the instant invention comprises an adapter system for positioning a longitudinally disposed centerline of a force-transmitting member, such as a slack adjuster a predetermined distance above a predetermined horizontally disposed plane of a transfer lever in a railway vehicle braking system. This adapter system comprises a J-shaped member engageable with the transfer lever. The J-shaped member has at least a first portion and a second portion which are substantially horizontally disposed in a substantially parallel relationship with each other and are connected together with a substantially vertically disposed third portion. This first portion has a predetermined length which is greater than a predetermined length of the second portion and extends above and substantially parallel with at least a portion of the transfer lever. The second portion is positioned below an end of the transfer lever and the third portion is positioned adjacent an edge of the end of the transfer lever. A connecting means is provided for connecting the transfer lever between the first and second portions of the J-shaped member. A jaw member is provided which is connected to an end of a slack adjuster. This jaw member is engageable with the first portion of the J-shaped member such that a longitudinally disposed centerline of the slack adjuster is positioned a predetermined distance above a predetermined horizontally disposed plane of the transfer lever. This adapter system enables the slack adjuster to be lifted up with respect to the transfer lever to ensure sufficient clearance of the slack adjuster through the opening in the bolster of the truck and to prevent undesirable rubbing of the slack adjuster in the bolster bowl area of the truck.

Although a number of objects and advantages of the present invention have been described in some detail above, various additional objects and advantages of the adapter system of the present invention will become more readily apparent to those persons who are skilled in the art from the following more detailed description of the invention, particularly, when such detailed description of the invention is taken in conjunction with both the attached drawing figures and with the appended claims.

DETAILED DESCRIPTION OF THE INVENTION

Figure 1:
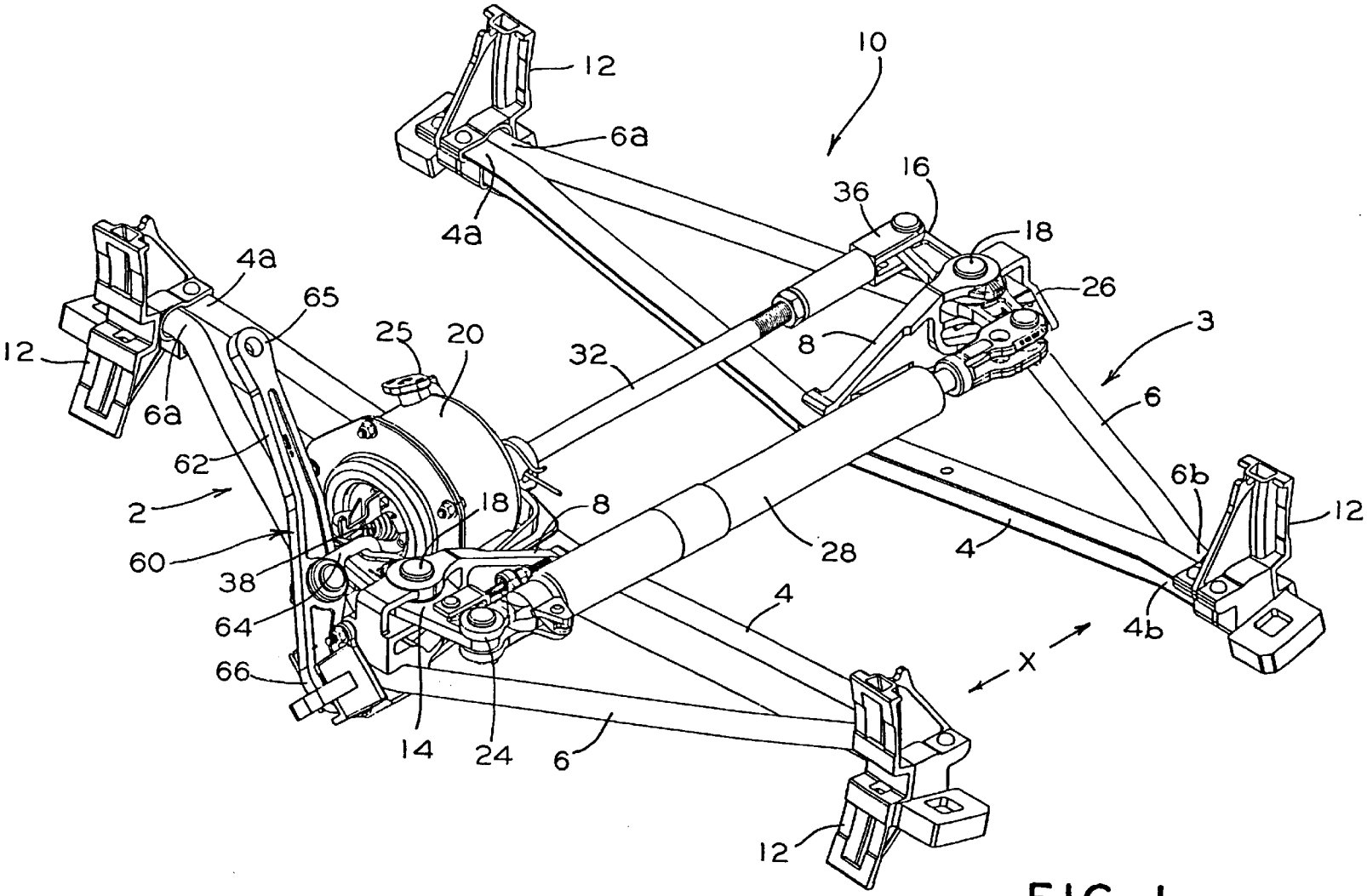
FIG. 1 PRIOR ART
FIG. 1 is a plan view of a railway vehicle truck mounted brake assembly according to the prior art.

Prior to proceeding with a more detailed description of the invention, it should be noted that for the sake of clarity, identical components which have identical functions have been identified with identical reference numerals throughout the several views illustrated in the attached drawing figures.

Figure 2:
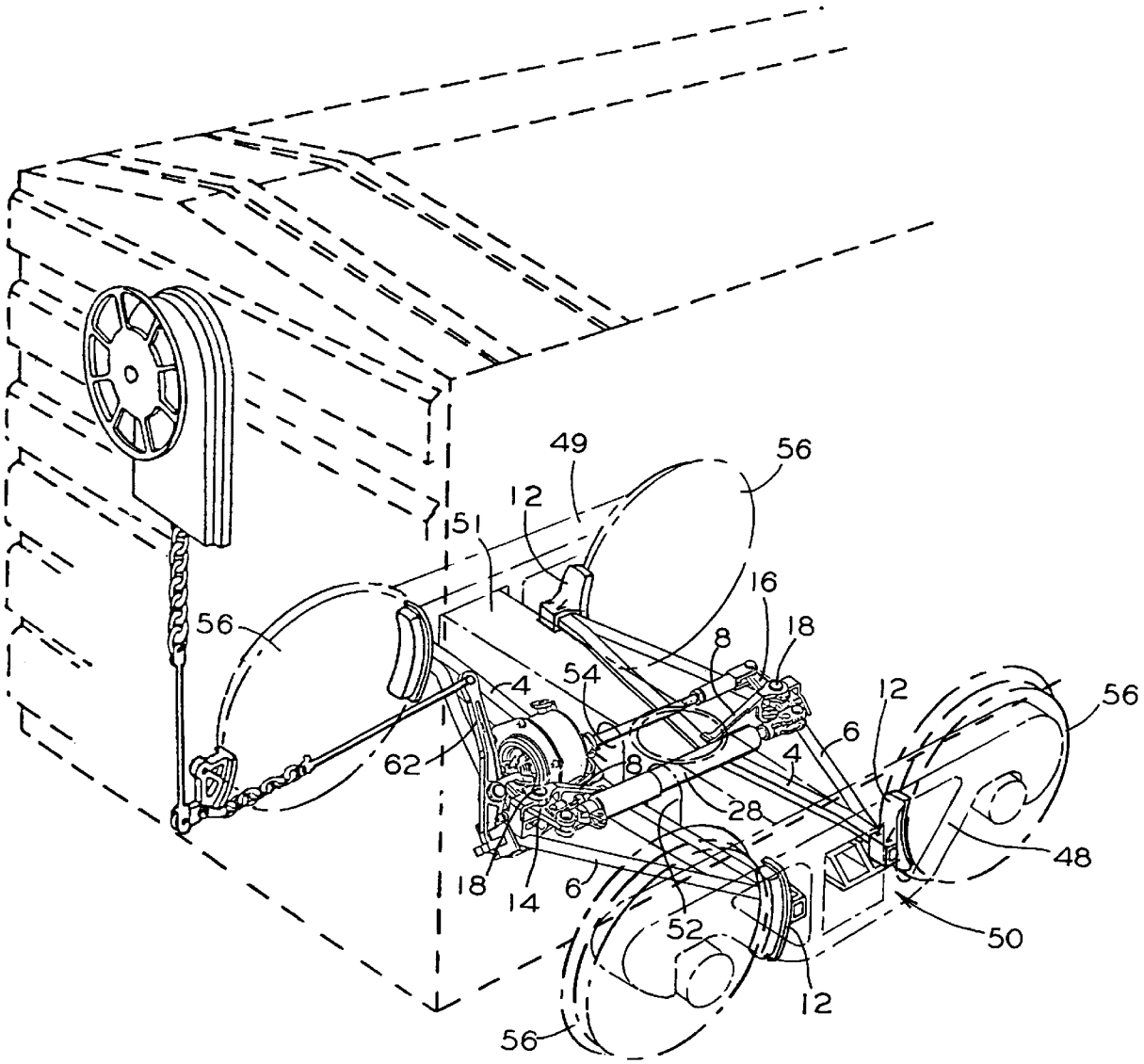
PRIOR ART FIG. 2
FIG. 2 is a plan view of the prior art railway vehicle truck mounted brake assembly of FIG. 1 mounted on a railway truck.

Referring now to FIGS. 1–2, there is shown a presently preferred embodiment of a truck-mounted brake assembly, generally designated 10, for a railway car (not shown). This brake assembly 10 comprises brake beams, generally designated 2 and 3, which are substantially identical. Each of the brake beams 2 and 3 includes a compression member 4, a tension member 6 and a strut member 8. The opposite ends of the compression member 4 and the tension member 6 may be permanently connected together, preferably by welding along an outer segment 4*a*–6*a*, 4*b*–6*b* at the opposite ends of the compression member 4 and the tension member 6.

At a location substantially midway between their opposite ends, the compression member 4 and the tension member 6 of the, respective, brake beams 2 and 3 are spaced apart sufficiently to allow connection of the strut member 8 therebetween. Mounted on the respective outer end segments 4*a*–6*a* and 4*b*–6*b* of the brake beams 2 and 3 are brake heads 12.

First and second force-transfer levers 14 and 16 are pivotally connected by pins 18 to the strut member 8 of the respective brake beams 2 and 3. The end 36 of the second force-transfer lever 16 is connected to the pressure head of the brake cylinder assembly 20 via a first force-transmitting means or a return push rod assembly 32. Each end 24 and 26 of the respective force-transfer levers 14 and 16 is interconnected via a second force-transmitting means 28, which may be in the form of an automatic slack adjuster device. A brake cylinder flange type air inlet 25 is provided on the brake cylinder assembly 20.

The brake cylinder assembly 20 is connected to both the strut member 8, adjacent one side thereof, and the compression member 4 in the space located between the compression member 4 and the tension member 6. In this arrangement, the weight of the brake cylinder assembly and the force-transmitting means is carried by the brake beams 2 and 3, which are, in turn, supported by the truck side frames 48, 49.

When a brake application is made, pressurization of the brake cylinder assembly 20 will result in actuation of the air brake cylinder piston located in the brake cylinder assembly 20. This actuation of the piston causes movement of the piston rod, also located in the cylinder assembly, in a forward direction which causes a return spring, also located in the brake cylinder assembly 20, to compress. Actuation of the brake cylinder, in this manner, will result in movement of a push rod 38 in a direction to effect a counterclockwise rotation of the first force-transfer lever 14. This first force-transfer lever 14, in turn, actuates the second force transmitting means or slack adjuster assembly 28 to effect counterclockwise rotation of the second force-transfer lever 16 and consequent actuation of the first force transmitting means or return push rod assembly 32.

The force-transfer levers 14 and 16, along with the slack adjuster assembly 28, the return push rod assembly 32 and the brake cylinder assembly 20 comprise a brake beam actuating linkage that interconnects the, respective, brake beams 2 and 3 via the pivot pins 18 and thus the required brake actuation forces effectively act along these pivot pins 18. The resultant of these forces is shown at X. Because the slack adjuster assembly 28 acts as a rigid member during a brake application, it is important that the length of the slack adjuster assembly 28 be allowed to increase with brake shoe wear and/or loss of a brake shoe during service so that movement of the brake cylinder piston and piston rod will enable such brake beams 2 and 3 to be moved apart by the brake beams linkage until brake shoe engagement with the tread surface of the vehicle wheels occurs.

As illustrated in FIG. 2, the truck mounted braking system is positioned on the railway truck, generally designated as 50, such that the first and second force transmitting means 32, 28 extend through openings 52,54 in the bolster portion 51 of the truck. The first and second brake beams 2, 3 along with their corresponding brake shoes 12 and the first and second transfer levers 14, 16 are positioned at either end of the truck. When a brake application is made, the brake beams 2, 3 move outward such that the brake shoes 12 come into contact with the wheels 56 of the railway vehicle.

Cooperatively arranged with the above-described brake rigging is a handbrake mechanism, generally designated 60, comprising an actuating lever 62 and a U-shaped transfer link 64. The transfer link 64 is connected to the first transfer lever 14 so as to be arcuately movable therewith in a plane parallel to the plane of rotation of the first transfer lever 14. The actuating lever 62 has a pivotal connection with the transfer link 64. This pivotal connection is at a location which is intermediate the ends 65,66 of the actuating lever. One end 65 of the actuating lever is adapted to receive a handbrake force and the other end 66 of the actuating lever is mounted so as to provide a point about which the actuating lever 62 is rotatable such that rotation of the actuating lever 62 cooperates with the transfer link 64 to cause a rotation of the first transfer lever 14.

Figure 3:
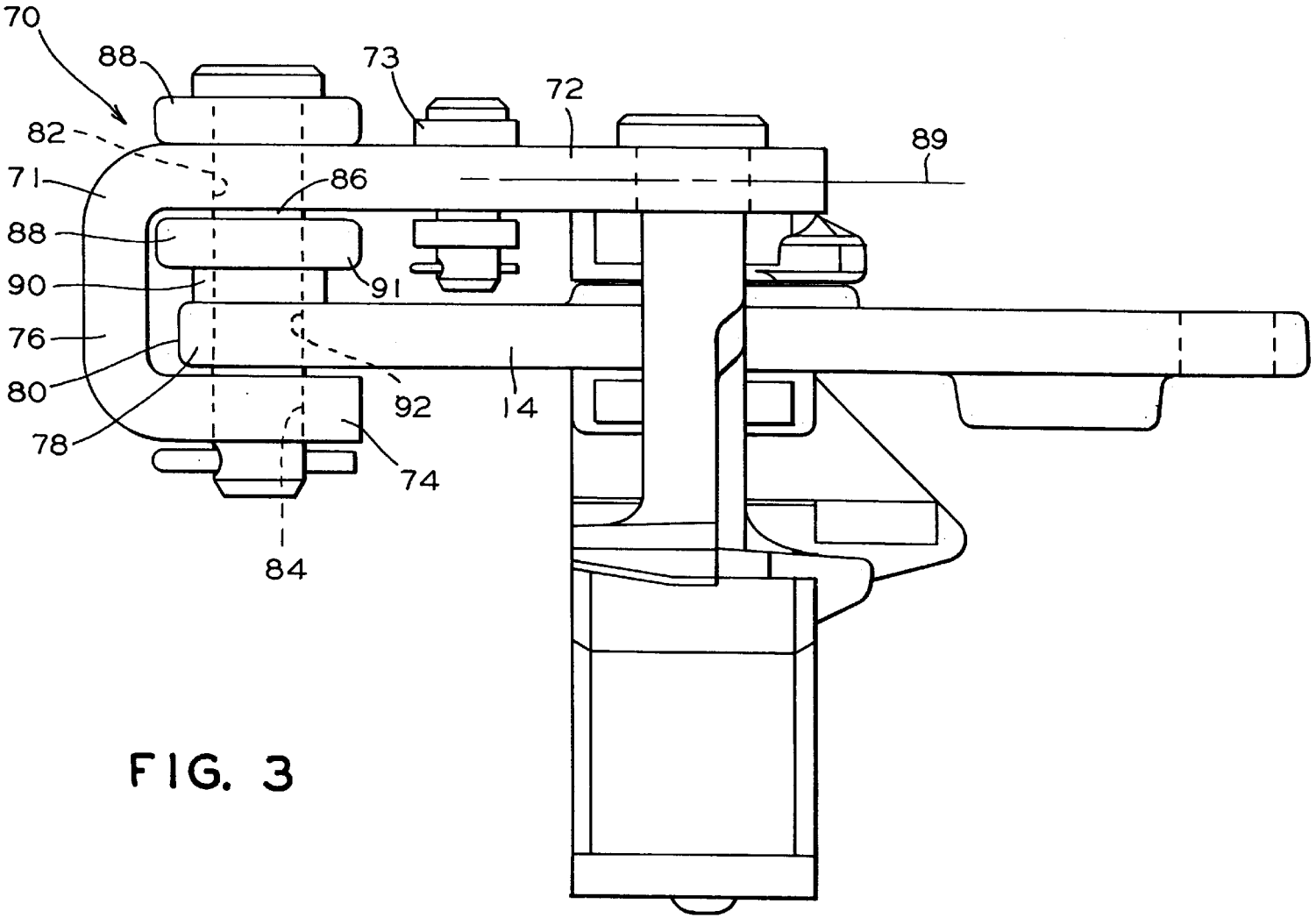
FIG. 3 is plan view of the adapter system of the present invention taken from an end view of the truck mounted brake assembly.

FIG. 3 shows a plan view of the adapter system, generally designated as 70, of the present invention taken from an end view of the truck mounted brake assembly. The adapter system 70 comprises a J-shaped member 71 which is engageable with the first transfer lever 14. This J-shaped member 71 has at least a first portion 72 and a second portion 74 which are substantially horizontally disposed in a substantially parallel relationship with each other and are connected together with a substantially vertically disposed third portion 76. The first portion 72 has a predetermined length which is greater than a predetermined length of the second portion 74 and extends above and substantially parallel with at least a portion of the first transfer lever 14. The second portion 74 of the J-shaped member 71 is positioned below an end 78 of the transfer lever and the third portion 76 is positioned adjacent an edge 80 of the end 78 of the transfer lever.

A first aperture 82 is provided which extends through the first portion 72 of the J-shaped member 71 and a second aperture 84 is provided which extends through the second portion 74 of the J-shaped member 71. The first and second apertures are substantially in axial alignment with each other. A connecting means 86, such as a pin, extends through the first 82 and second 84 aperture and is engageable with the first transfer lever 14, such as by means of a third aperture 92 such that this transfer lever is located between the first 72 and second 74 portion of the J-shaped member 71.

A jaw member 88 is connected to an end of the second force transmitting means 28, typically a slack adjuster. This jaw member 88 is engageable with the first portion 72 of the J-shaped member 71 such that a longitudinally disposed centerline 89 of the slack adjuster 28 is positioned a predetermined distance above a predetermined horizontally disposed plane of the first transfer lever 14. This predetermined horizontally disposed plane of the first transfer lever can include the top surface or bottom surface of the first transfer lever 14 or any plane between these surfaces. The trigger member 73 for the slack adjuster 28 is also engageable with the first portion 72 of the J-shaped member 71 such as by securing the trigger member 73 through an aperture in the first portion 72 of the J-shaped member 71 with a pin.

The adapter system of the present invention is capable of positioning the longitudinally disposed centerline 89 of the second force transmitting means 14 approximately 0.5–2.0 inches above the horizontally disposed plane of the first transfer lever. Raising of the second force transfer lever, or slack adjuster 28 allows the use of the truck mounted braking system on the newer truck designs as it ensures that sufficient clearance is provided in the opening 52 of the bolster 51 of which the slack adjuster extends through and eliminates the undesirable rubbing of the slack adjuster against the bolster bowl of the truck 50.

Also included in the adapter system of the present invention is a support washer 90 which can be mounted on the connecting means 86 in a position which is between the first transfer lever 14 and the bottom portion 91 of the jaw member of the slack adjuster 28.

A second adapter system (not shown) similar to the above described adapter system may be mounted on the second force transfer lever 16 such that an opposite end of the second force transmitting member 28 may also be positioned above the predetermined horizontally extending plane of the second transfer lever 16.

Thus, the present invention has been described in such full, clear, concise and exact terms as to enable any person skilled in the art to which it pertains to make and use the same. It will be understood that variations, modifications, equivalents, and substitutions for components of the specifically described embodiments of the invention may be made by those skilled in the art without departing from the spirit and scope of the invention as set forth in the appended claims.

We claim:

1. An adapter system for positioning a longitudinally disposed centerline of a slack adjuster a predetermined distance above a predetermined horizontally disposed plane of a transfer lever in a railway vehicle braking system, said adapter system comprising:

(a) a J-shaped member engageable with such transfer lever, said J-shaped member having at least a first portion and a second portion, said first and second portions being substantially horizontally disposed in a substantially parallel relationship with each other and being connected together with a substantially vertically disposed third portion, said first portion having a predetermined length greater than a predetermined length of said second portion, said first portion extending above and substantially parallel with at least a portion of such transfer lever, said second portion being positioned below an end of such transfer lever, and said third portion being positioned adjacent an edge of said end of such transfer lever;

(b) a first aperture extending through said first portion of said J-shaped member and a second aperture extending through said second portion of said J-shaped member, said second aperture being substantially in axial alignment with said first aperture;

(c) a connecting means extending through said first and second aperture and engageable with such transfer lever such that such transfer lever is located between said first and second portion of said J-shaped member;

(d) a jaw member connected to an end of such slack adjuster, said jaw member engageable with said first portion of said J-shaped member such that a longitudinally disposed centerline of such slack adjuster is positioned a predetermined distance above a predetermined horizontally disposed plane of such transfer lever.

2. An adapter system as recited in claim 1 including a support washer mounted on said connecting means and positioned between such transfer lever and a portion of said jaw member of such slack adjuster.

3. An adapter system as recited in claim 1 including a third aperture extending through an end portion of such transfer lever substantially in alignment with said first and second apertures and said means for connecting such transfer lever between said first and second portion of said J-shaped member includes a pin extending through said first, second and third apertures.

4. A railway vehicle braking system comprising:

(a) first and second spaced apart brake beams;

(b) first and second transfer levers pivotally connected at a point intermediate the ends thereof to a respective one of said first and second brake beams;

(c) first force-transmitting means connected between corresponding arms of said first and second transfer levers including a brake actuator means operable in response to a supply of fluid pressure thereto for effecting rotation of said first transfer lever; and (d) second force transmitting means connected between the opposed arms of said first and second transfer levers, said second force transmitting means having a longitudinally disposed centerline which is positioned at a predetermined distance above a predetermined horizontally disposed plane of at least one of said first and second transfer levers, said second force transmitting means effecting rotation of said second transfer lever in response to said rotation of said first transfer lever, whereby a force is exerted on said first and second brake beams at said pivotal connection of said first and second transfer levers therewith in opposite directions to accordingly increase the spaced apart distance between said first and second brake beams enabling braking of such railway vehicle.

5. A railway vehicle braking system as recited in claim 4 including an adapter system associated with said first transfer lever for positioning said longitudinally disposed centerline of said second force transmitting means a predetermined distance above a predetermined horizontally disposed plane of said first transfer lever.

6. A railway vehicle braking system as recited in claim 5 wherein said adapter system associated with said first transfer lever includes a J-shaped member engageable with said first transfer lever, said J-shaped member having at least a first portion and a second portion, said first and second portions being substantially horizontally disposed in a substantially parallel relationship with each other and being connected together with a substantially vertically disposed third portion, said first portion having a predetermined length greater than a predetermined length of said second portion, said first portion extending above and substantially parallel with at least a portion of said first transfer lever, said second portion being positioned below an end of said first transfer lever, and said third portion being positioned adjacent an edge of said end of said first transfer lever;

means for connecting said first transfer lever between said first and second portions of said J-shaped member; and means for engaging an end of said second force transmitting means with said first portion of said J-shaped member such that said longitudinally disposed centerline of said second force transmitting means is positioned a predetermined distance above a predetermined horizontally disposed plane of said first transfer lever.

7. A railway vehicle braking system as recited in claim 6 wherein said first portion of said J-shaped member includes a first aperture extending therethrough, said second portion of said J-shaped member includes a second aperture extending therethrough and said first transfer lever includes a third aperture extending through said end portion thereof, said first, second, and third apertures being substantially in axial alignment with each other and said means for connecting said first transfer lever between said first and second portion of said J-shaped member includes a pin extending through said first, second, and third apertures.

8. A railway vehicle braking system as recited in claim 7 including a jaw member connected to a first end of said second force transmitting means, said jaw member being engageable with said first portion of said J-shaped member.

9. A railway vehicle braking system as recited in claim 4 wherein said second force transmitting means comprises a slack adjuster.

10. A railway vehicle braking system as recited in claim 8 wherein said second force transmitting means comprises a slack adjuster.

11. A railway vehicle braking system as recited in claim 10 including a trigger member for said slack adjuster engageable with said first portion of said J-shaped member.

12. A railway vehicle braking system as recited in claim 8 including a support washer mounted on said connecting means and positioned between said first transfer lever and a portion of said jaw member of said second force transmitting means.

13. A railway vehicle braking system as recited in claim 4 including a bolster having a plurality of openings extending therethrough, said second force transmitting means extending through one of said plurality of openings of said bolster.

14. A railway vehicle braking system as recited in claim 5 including a second adapter system associated with said second transfer lever for positioning said longitudinally disposed centerline of said second force transmitting means a predetermined distance above a predetermined horizontally disposed plane of said second transfer lever.

15. A railway vehicle braking system as recited in claim 14 wherein said second adapter system associated with said second force transfer lever includes a J-shaped member engageable with said second transfer lever, said J-shaped member having at least a first portion and a second portion, said first and second portions being substantially horizontally disposed in a substantially parallel relationship with each other and being connected together with a substantially vertically disposed third portion, said first portion having a predetermined length greater than a predetermined length of said second portion, said first portion extending above and substantially parallel with at least a portion of said second transfer lever, said second portion being positioned below an end of said second transfer lever, and said third portion being positioned adjacent an edge of said end of said second transfer lever;

means for connecting said second transfer lever between said first and second portions of said J-shaped member; and means for engaging an end of said second force transmitting means with said first portion of said J-shaped member such that said longitudinally disposed centerline of said second force transmitting means is positioned a predetermined distance above a predetermined horizontally disposed plane of said second transfer lever.

16. A railway vehicle braking system as recited in claim 15 wherein said first portion of said J-shaped member includes a first aperture extending therethrough, said second portion of said J-shaped member includes a second aperture extending therethrough and said second transfer lever includes a third aperture extending through an end portion thereof, said first, second, and third apertures being substantially in axial alignment with each other and said means for connecting said second transfer lever between said first and second portion of said J-shaped member includes a pin extending through said first, second, and third apertures.

17. A railway vehicle braking system as recited in claim 16 including a jaw member connected to a second end of said second force transmitting means, said jaw member being engageable with said first portion of said J-shaped member.

18. A railway vehicle braking system as recited in claim 17 including a support washer mounted on said connecting means and positioned between said second transfer lever and a portion of said jaw member connected to a second end of said second force transmitting means.

19. A railway vehicle braking system comprising:

(a) first and second spaced apart brake beams;

(b) first and second transfer levers pivotally connected at a point intermediate the ends thereof to a respective one of said first and second brake beams;

(c) first force-transmitting means connected between corresponding arms of said first and second transfer levers including a brake actuator means operable in response to a supply of fluid pressure thereto for effecting rotation of said first transfer lever;

(d) a transfer link connected to said first transfer lever so as to be arcuately movable therewith in a plane parallel to the plane of rotation of said first transfer lever;

(e) an actuating lever having a pivotal connection with said transfer link, said pivotal connection being at a location intermediate the ends of said actuating lever, one end of said actuating lever being adapted to receive a handbrake force and the other end of said actuating lever being mounted so as to provide a point about which said actuating lever is rotatable such that rotation of said actuating lever cooperates with said transfer link to cause a rotation of said first transfer lever; and (f) second force transmitting means connected between the opposed arms of said first and second transfer levers, said second force transmitting means having a longitudinally disposed centerline which is positioned at a predetermined distance above a predetermined horizontally disposed plane of at least one of said first and second transfer levers, said second force transmitting means effecting rotation of the second transfer lever in response to said rotation of said first transfer lever, whereby a force is exerted on said first and second brake beams at said pivotal connection of said first and second transfer levers therewith in opposite directions to accordingly increase the spaced apart distance between said first and second brake beams enabling braking of such railway vehicle.

20. A railway vehicle braking system as recited in claim 19 including an adapter system associated with said first transfer lever for positioning said longitudinally disposed centerline of said second force transmitting means a predetermined distance above a horizontally disposed plane of said first transfer lever.

21. A railway vehicle braking system as recited in claim 20 wherein said adapter system associated with said first transfer lever includes a J-shaped member engageable with said first transfer lever, said J-shaped member having at least a first portion and a second portion, said first and second portions being substantially horizontally disposed in a substantially parallel relationship with each other and being connected together with a substantially vertically disposed third portion, said first portion having a predetermined length greater than a predetermined length of said second portion, said first portion extending above and substantially parallel with at least a portion of said first transfer lever, said second portion being positioned below an end of said first transfer lever, and said third portion being positioned adjacent an edge of said end of said first transfer lever;

means for connecting said first transfer lever between said first and second portion of said J-shaped member; and means for engaging an end of said second force transmitting means with said first portion of said J-shaped member such that said longitudinally disposed centerline of said second force transmitting member is positioned a predetermined distance above a horizontally disposed plane of said first transfer lever.

22. A railway vehicle braking system as recited in claim 21 wherein said first portion of said J-shaped member includes a first aperture extending therethrough, said second portion of said J-shaped member includes a second aperture extending therethrough and said first transfer lever includes a third aperture extending through an end portion thereof, said first, second, and third apertures being substantially in axial alignment with each other and said means for connecting said first transfer lever between said first and second portion of said J-shaped member includes a pin extending through said first, second, and third apertures.

23. A railway vehicle braking system as recited in claim 21 including a jaw member connected to a first end of said second force transmitting means, said jaw member being engageable with said first portion of said J-shaped member.

* * * * *